US006257754B1

(12) United States Patent
Søndergaard

(10) Patent No.: US 6,257,754 B1
(45) Date of Patent: Jul. 10, 2001

(54) MIXING DEVICE AND FLUE GAS CHANNEL PROVIDED THEREWITH

(75) Inventor: Kristian Søndergaard, Vejby (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 09/191,052

(22) Filed: Nov. 12, 1998

Related U.S. Application Data

(60) Provisional application No. 60/065,231, filed on Nov. 13, 1997.

(51) Int. Cl.[7] ..... B01F 5/00

(52) U.S. Cl. ..... 366/174.1; 366/175.2; 366/336

(58) Field of Search ..... 366/174.1, 175.2, 366/336, 337, 338, 167.1; 138/40, 42, 44

(56) References Cited

U.S. PATENT DOCUMENTS

| | | | | |
|---|---|---|---|---|
| 3,734,111 | * | 5/1973 | McClintock | 366/174.1 |
| 3,749,130 | * | 7/1973 | Howitt et al. | 138/42 |
| 3,782,080 | | 1/1974 | Gallagher | 55/226 |
| 3,818,938 | * | 6/1974 | Carson | 366/167.1 |
| 4,043,539 | * | 8/1977 | Giler et al. | 138/42 |
| 4,073,832 | | 2/1978 | McGann | 261/118 |
| 4,087,862 | | 5/1978 | Tsien | 366/165 |
| 4,144,041 | | 3/1979 | Hou | 55/226 |
| 4,210,428 | | 7/1980 | Schneider et al. | 55/223 |
| 4,313,680 | | 2/1982 | Honnen | 366/337 |
| 4,936,716 | * | 6/1990 | Andeson | 138/42 |
| 4,994,242 | * | 2/1991 | Rae et al. | 366/336 |
| 5,145,256 | | 9/1992 | Wiemers et al. | 366/336 |
| 5,435,976 | * | 7/1995 | Berner et al. | 366/337 |
| 5,758,497 | | 6/1998 | Frederiksen et al. | 60/299 |
| 5,793,831 | * | 8/1998 | Tsiklauri et al. | 366/167.1 |

FOREIGN PATENT DOCUMENTS

| | | | | |
|---|---|---|---|---|
| 169823B1 | | 7/1993 | (DK) . | |
| 2537650 | | 6/1984 | (FR) . | |
| 2158878 | | 11/1985 | (GB) . | |
| 59-136124 | * | 8/1984 | (JP) | 366/174.1 |
| 61-138520 | * | 6/1986 | (JP) | 366/175.2 |
| 2009709 | * | 3/1994 | (RU) | 366/175.2 |
| 725689 | * | 4/1980 | (SU) | 366/336 |
| WO 94/18438 | * | 8/1994 | (WO) . | |

* cited by examiner

*Primary Examiner*—Tony G. Soohoo
(74) *Attorney, Agent, or Firm*—Ostrolenk, Faber, Gerb & Soffen, LLP

(57) ABSTRACT

Mixing device for mixing of a first and second gas stream comprising within a housing at least one deflection body causing the gas streams to be radially deflected within the housing; and a nozzle device for introduction of the second gas stream, arranged rotational symmetric to axis of the housing.

11 Claims, 1 Drawing Sheet

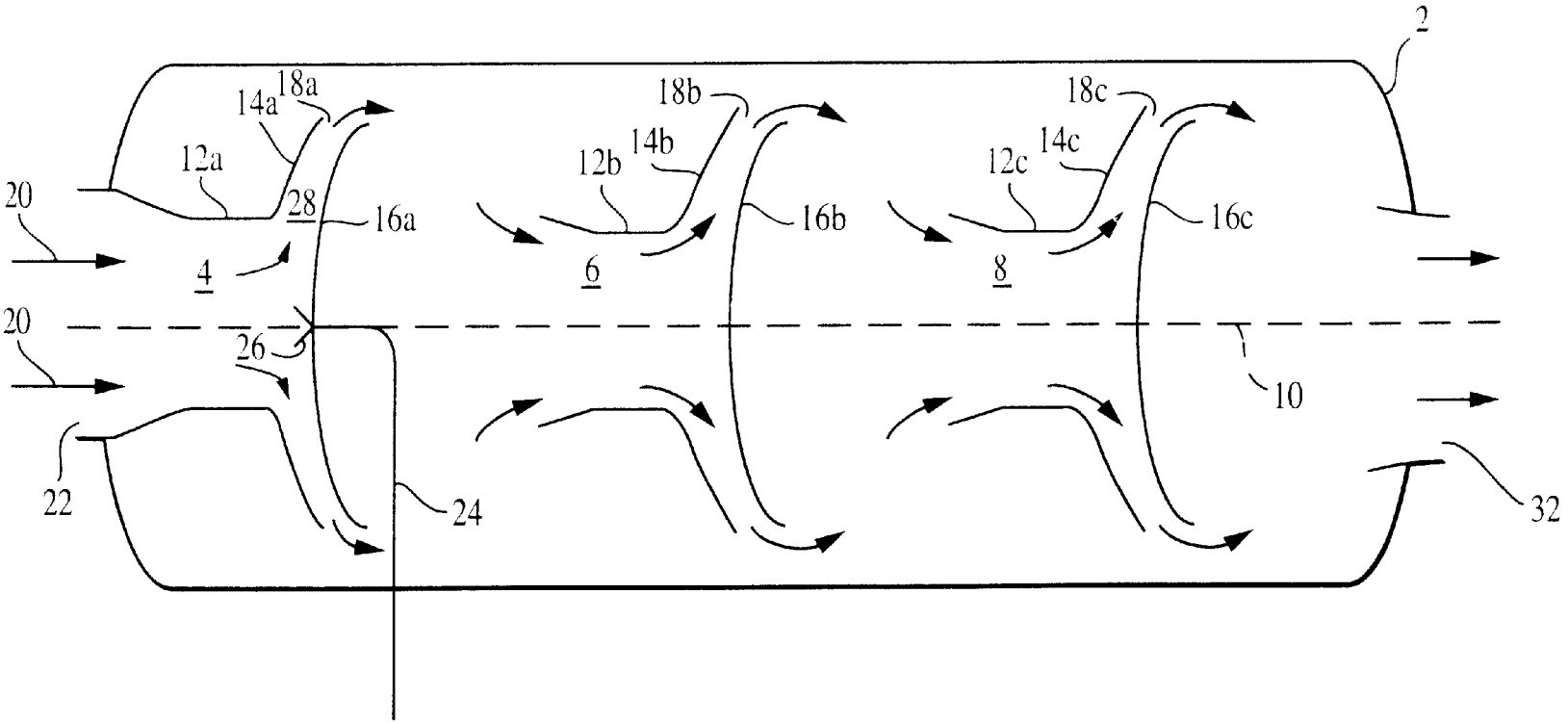
2
32
10
16c
18c
14c
12c
8
16b
18b
14b
12b
6
24
16a
18a
14a
28
12a
4
26
20
20
22

MIXING DEVICE AND FLUE GAS CHANNEL PROVIDED THEREWITH

This application claims the benefit of U.S. Provisional Application Ser. No. 60/065,231, filed Nov. 13, 1997.

The present invention relates to the mixing of fluid and in particular to a mixing device with a deflection body for the mixing of two fluid streams.

It has now been found that when deflecting a gas-stream of different gases the gases are mixed thoroughly, in particular radial diffusers provide evenly mixing of gas streams as described in DK Patent No. 169,823 and PCT/DK/9500200.

Accordingly, this invention provides a mixing device for mixing of a first and second gas stream comprising within a housing at least one deflection body causing the gas streams to be radially deflected within the housing; and a nozzle device for introduction of the second gas stream, arranged rotational symmetric to axis of the housing.

The mixing device according to the invention is in particular useful when installed in flue or waste gas channels provided with a catalytic compartment for the treatment of off-gases, wherein a reactant gas or a spray of reactive particles in liquid or solid phase is admixed with the off-gas for the catalytic treatment of the gas. In those applications the combined silencing and mixing effect of the mixing device advantageously reduces the overall dimensions of the channels and pressure drop of the gas, when compared to channels with separate silencing and mixing equipment. Accordingly, the invention further provides an off-gas channel comprising one or more catalyst beds for the catalytic treatment of off-gas in presence of a reactant gas, wherein the off-gas channel further comprises a mixing device of the above described type for the silencing and mixing of the off-gas and the reactant gas prior to introduction into the catalyst bed.

In the following description a specific embodiment of the invention is described in further detail with reference to the drawing in which the sole Figure shows a mixing device with radial diffuser elements arranged in series.

The mixing device comprises within cylindrical housing 2 three radial diffuser elements 4, 6, 8 arranged in series along axis 10 within housing 2.

Radial diffuser elements 4, 6, 8 consist each of a cylindrical inlet end 12*a*, 12*b* and 12*c*, respectively, connected to curved guide baffle 14*a*, 14*b*, 14*c* and a curved stagnation baffle 16*a*, 16*b*, 16*c*, which causes partial flow stagnation of a gas stream and leads the gas stream radially to outlet ends 18*a*, 18*b* and 18*c* as indicated by arrows.

An incoming off-gas stream 20 is introduced in the mixing device through inlet 22 in housing 2 and passed to inlet 22 of the first radial diffuser 4.

Prior to radial diffusion of the gas stream the stream is admixed with a reactant gas from tube 24.

Reactant gas 24 is introduced into gas stream 20 through nozzle 26 arranged centrally on stagnation baffle 14*a*. The mixed gas stream is then passed radially through conduct 28 between guide baffle 14*a* and stagnation baffle 16*a* to outlet ends 18*a*. The mixed gas stream is further sequentially introduced into diffuser elements 6 and 8. By passage through the above described mixing device, the reactant gas is mixed thoroughly with the off-gas stream and withdrawn as a homogeneous gas stream at outlet end 32 of the mixing device.

What is claimed is:

1. Mixing device for mixing a first and second gas stream, comprising within a housing at least one deflection body causing the first and second gas streams to be radially deflected within the housing, the deflection body being in form of a radial diffuser with a curved guide baffle and ajuxtaposed curved stagnation baffle; and a nozzle device for introduction of the second gas stream arranged rotationally symmetrical, to the axis of the housing, wherein the nozzle device is arranged on the curved stagnation baffle, and the curved stagnation baffle and the curved guide baffle are rotational symmetric to the axis of the housing.

2. Mixing device according to claim 1, wherein the deflection body is in form of a radial diffuser with a guide baffle and a juxtaposed stagnation baffle.

3. Off-gas channel for the catalytic treatment of a off-gas, said channel being provided therein with a mixing device according to claim 2.

4. Mixing device according to claim 1, wherein the nozzle device is arranged at inlet of the diffuser.

5. Off-gas channel for the catalytic treatment of a off-gas, said channel being provided therein with a mixing device according to claim 4.

6. Mixing device according to claim 1, wherein the nozzle device is arranged on axis of the stagnation baffle.

7. Off-gas channel for the catalytic treatment of a off-gas, said channel being provided therein with a mixing device according to claim 6.

8. Mixing device according to claim 1, wherein the housing is provided within a section of an off-gas channel.

9. Off-gas channel for the catalytic treatment of a off-gas, said channel being provided therein with a mixing device according to claim 8.

10. Off-gas channel for the catalytic treatment of an off-gas, said channel being provided therein with a mixing device according to claim 1.

11. Mixing device according to claim 1, wherein the housing is part of a section of an off-gas channel.

* * * * *